US007192039B1

(12) United States Patent
Snedaker

(10) Patent No.: US 7,192,039 B1
(45) Date of Patent: Mar. 20, 2007

(54) SKATEBOARD TRUCK MOUNTING ASSEMBLY, AND METHODS FOR MAKING AND USING SAME

(76) Inventor: Lee William Snedaker, 4600 Monterey Oaks Blvd., #618, Austin, TX (US) 78749

( * ) Notice: Subject to any disclaimer, the term of this patent is extended or adjusted under 35 U.S.C. 154(b) by 166 days.

(21) Appl. No.: 10/824,868

(22) Filed: Apr. 15, 2004

Related U.S. Application Data

(60) Provisional application No. 60/471,784, filed on May 20, 2003.

(51) Int. Cl.
*B62M 1/00* (2006.01)

(52) U.S. Cl. ..... 280/87.042; 280/87.041; 280/87.021

(58) Field of Classification Search ..... 411/301, 411/304, 417, 418, 419, 525, 910; 280/11.223, 280/11.27, 87.01, 87.021, 87.041, 87.042
See application file for complete search history.

(56) References Cited

U.S. PATENT DOCUMENTS 1,158,454 A * 11/1915 De Camp ..... 411/259
2,510,722 A * 6/1950 Snyder ..... 280/11.28
2,664,294 A * 12/1953 Kleinman ..... 280/11.27
3,079,968 A * 3/1963 Buckley ..... 411/304
3,150,702 A * 9/1964 Buckley et al. ..... 411/304
3,173,466 A * 3/1965 Starriett et al. ..... 411/304
3,176,744 A * 4/1965 Brightman ..... 411/304
3,554,258 A * 1/1971 Duffy ..... 411/301
4,029,330 A * 6/1977 Runyan, Jr. ..... 280/87.042
4,060,253 A * 11/1977 Oldendorf ..... 280/87.042
4,120,510 A * 10/1978 Hillard ..... 280/87.042
4,155,565 A * 5/1979 de Caussin et al. ..... 280/87.042
4,245,848 A * 1/1981 Dudouyt ..... 280/11.28
4,475,858 A * 10/1984 Benjamin et al. ..... 411/304
4,759,671 A * 7/1988 Duran ..... 411/347
4,930,794 A * 6/1990 Chan ..... 280/11.28
5,704,748 A * 1/1998 Criswell ..... 411/304
5,947,668 A * 9/1999 Thommes ..... 411/304
6,224,076 B1 * 5/2001 Kent ..... 280/87.042
6,280,133 B1 * 8/2001 Haberle ..... 411/392
6,293,571 B1 * 9/2001 Wen ..... 280/87.042
6,646,547 B2 * 11/2003 Chiu ..... 340/321

FOREIGN PATENT DOCUMENTS

FR 2609761 A * 7/1988

* cited by examiner

*Primary Examiner*—Christopher P. Ellis
*Assistant Examiner*—Vaughn T. Coolman
(74) *Attorney, Agent, or Firm*—Eric Karich

(57) ABSTRACT

An assembly is disclosed for mounting a truck having multiple mounting holes passing therethrough. The assembly includes a pair of removable fasteners and a body having a pair of spaced apart holes. Each of the holes passes through the body, corresponds to a different one of the mounting holes of the truck, and is adapted to receive one of the removable fasteners. A described method for making the assembly includes providing a solid block of a hard substance. A pair of spaced apart holes are formed in the block, wherein each of the holes passes through the block and corresponds to a different one of the mounting holes of the truck. Each of the holes in the block is adapted to receive a removable fastener. A method for attaching a truck to a mating surface via the assembly is also disclosed.

1 Claim, 4 Drawing Sheets

SKATEBOARD TRUCK MOUNTING ASSEMBLY, AND METHODS FOR MAKING AND USING SAME

CROSS-REFERENCE TO RELATED APPLICATIONS

This application for a utility patent claims the benefit of U.S. Provisional Application No. 60/471,784, filed May 20, 2003, which is incorporated herein by reference in its entirety.

STATEMENT REGARDING FEDERALLY SPONSORED RESEARCH

Not Applicable

BACKGROUND OF THE INVENTION

1. Field of the Invention

This invention relates generally to skateboards, and more particularly to a mounting assembly for use with swiveling axle frames (i.e., "trucks") mounted to an underside of a skateboard.

2. Description of Related Art

A typical skateboard includes a pair of swiveling axle frames called trucks attached to an underside of a wooden deck. Each truck includes a baseplate and an axle assembly attached to the baseplate via a pair of resilient bushings and a substantially vertical bolt called a king pin. The baseplate is attached to the underside of the deck. Bearings and wheels are attached to opposite ends of the axle assemblies. The axle assembly may be rotated within a limited range of motion about a substantially vertical axis passing through the baseplate, allowing the skateboard to turn. When the axle assembly is rotated, the resilient bushings are compressed, providing stability and maneuverability.

In the typical skateboard, multiple sets of nuts and screws are used to attach the baseplate of each of the two trucks to the underside of the deck. In general, a screw is a fastener with a head and threaded shaft. It is noted that a fastener with a head and a threaded, non-tapered shaft is often called a bolt. As used herein the term "screw" refers to a fastener with a head and threaded shaft, wherein the shaft may or may not be tapered.

In attaching the baseplate of one of the trucks to the underside of the deck, each of multiple screws is passed through a hole in the deck and a hole in the baseplate, and nuts are threaded onto the threaded shafts of the screws. A wrench or socket is typically used to hold each of the nuts in place while the corresponding screw is tightened using a screwdriver or an Allen wrench.

During use of the skateboard, the screws attaching the baseplates of the trucks to the underside of the deck often tend to work loose. In this situation a wrench or socket is typically needed again to hold one or more of the nuts in place while the corresponding screws are tightened.

It would be advantageous to have an assembly for mounting a truck to an underside of a deck (e.g., a deck of a skateboard) that does not require a wrench or socket to hold each of multiple nuts in place while corresponding screws are tightened.

SUMMARY OF THE INVENTION

An assembly is disclosed for mounting a truck having multiple mounting holes passing therethrough. The assembly includes a pair of removable fasteners and a body having a pair of spaced apart holes. Each of the holes passes through the body, corresponds to a different one of the mounting holes of the truck, and is adapted to receive one of the removable fasteners. A described method for making the assembly includes providing a solid block of a hard substance. A pair of spaced apart holes are formed in the block, wherein each of the holes passes through the block and corresponds to a different one of the mounting holes of the truck. Each of the holes in the block is adapted to receive a removable fastener. A method for attaching a truck to a mating surface via the assembly is also disclosed.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
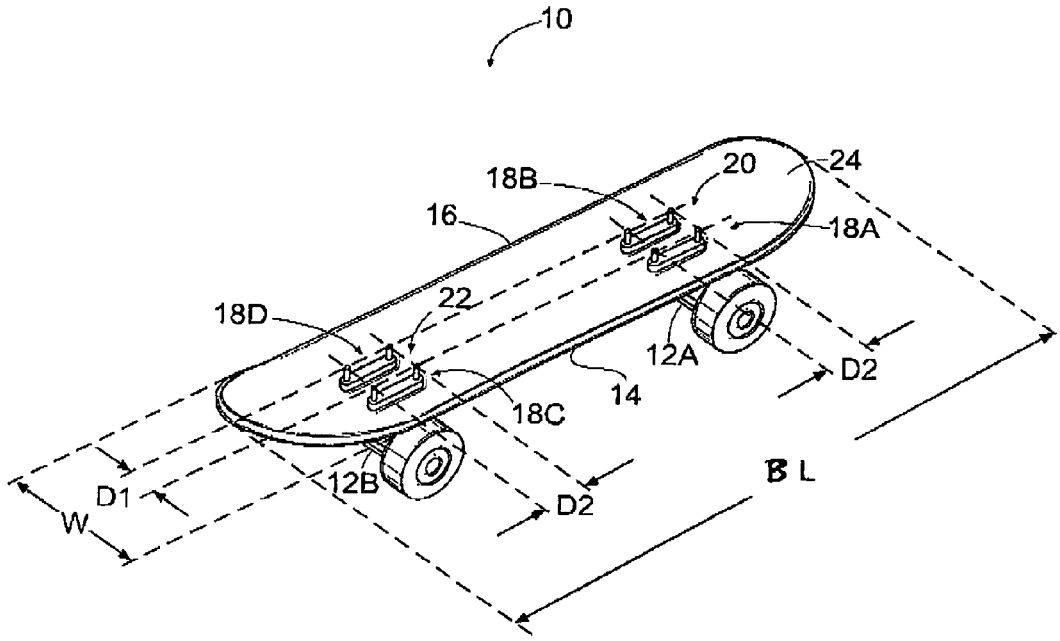
FIG. 1 is a perspective view of one embodiment of a skateboard including two trucks attached to an underside surface of a deck via four truck mounting assemblies.

FIG. 1 is a perspective view of one embodiment of a skateboard 10 including two trucks 12A and 12B attached to an underside surface 14 of a deck 16 via four truck mounting assemblies 18A–18D. The truck 12A is mounted near one end of the deck 16, and the truck 12B is mounted near an opposite end of the deck 16. The truck 12A is attached to the underside surface 14 of the deck 16 via the truck mounting assemblies 18A and 18B, and the truck 12B is attached to the underside surface 14 of the deck 16 via the truck mounting assemblies 18C and 18D.

In the embodiment of FIG. 1, the deck 16 has four spaced apart holes 20 near one end for mounting the truck 12A, and another four spaced apart holes 22 near the opposite end for mounting the truck 12B. The holes 20 and 22 extend between an upper surface 24 of the deck 16 and the underside surface 14. As indicated in FIG. 1, the holes 20 and 22 are spaced by a distance "D1" along a width dimension "W" of the skateboard 10, and by a distance "D2" along a length dimension "BL" of the skateboard 10. The truck 12A has four spaced apart mounting holes corresponding to the holes 20, and the truck 12B has four spaced apart mounting holes corresponding to the holes 22.

In general, and as described in more detail below, each of the truck mounting assemblies 18A–18D includes two removable fasteners and a body having a pair of holes adapted to receive the fasteners. The two holes in the body correspond to two of the mounting holes in the deck 16 and the trucks 12A and 12B. Portions of the removable fasteners pass through the corresponding mounting holes of the deck 16 and the trucks 12A and 12B and are received by the holes in the bodies of the truck mounting assemblies 18A–18D.

Figure 2A:
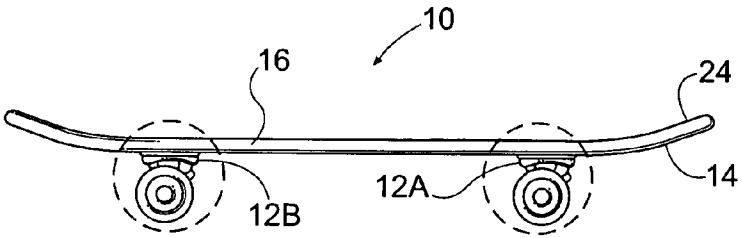
FIG. 2A is a side elevation view of the skateboard of FIG. 1.
Figure 2B:
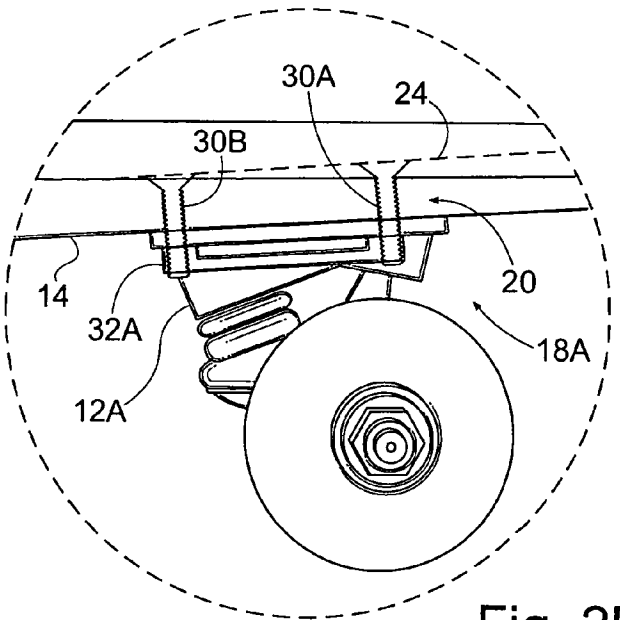
FIG. 2B is a view of a first portion of FIG. 2A including one of the trucks and a corresponding one of the truck mounting assemblies.

FIG. 2A is a side elevation view of the skateboard 10 of FIG. 1. FIG. 2B is a view of a first portion of FIG. 2A including the truck 12A and the truck mounting assembly 18A of FIG. 1. In the embodiment of FIG. 2B, the truck mounting assembly 18A includes two flat head machine screws 30A and 30B and a body 32A having a pair of threaded holes for receiving the screws 30A and 30B. The threaded holes in the body 32A correspond to two of the four mounting holes 20 in the deck 16 and in the truck 12A.

Each of the flat head machine screws 30A and 30B has a head and a threaded shaft. As shown in FIG. 2B, the threaded shafts of the screws 30A and 30B pass through the corresponding two of the four mounting holes 20 of the deck 16 and the truck 12A, and are received by the threaded holes in the body 32A of the truck mounting assembly 18A.

In the embodiment of FIG. 2B, the truck mounting assembly 18B of FIG. 1 also includes two flat head machine screws and a body having a pair of threaded holes for receiving the screws. The threaded holes in the body correspond to the other two of the four mounting holes 20 in the deck 16 and in the truck 12A. The threaded shafts of the screws pass through the corresponding two of the four mounting holes 20 of the deck 16 and the truck 12A, and are received by the threaded holes in the body.

Figure 2C:
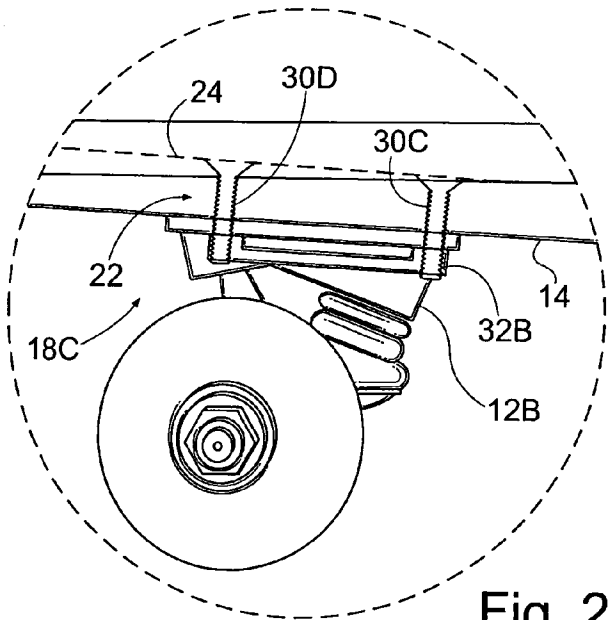
FIG. 2C is a view of a second portion of FIG. 2A including the other truck and a corresponding one of the truck mounting assemblies.

FIG. 2C is a view of a second portion of FIG. 2A including the truck 12B and the truck mounting assembly 18C of FIG. 1. In the embodiment of FIG. 2C, the truck mounting assembly 18C includes two flat head machine screws 30C and 30D and a body 32B having a pair of threaded holes for receiving the screws 30C and 30D. The threaded holes in the body 32B correspond to two of the four mounting holes 22 in the deck 16 and in the truck 12B.

Each of the flat head machine screws 30C and 30D has a head and a threaded shaft. As shown in FIG. 2C, the threaded shafts of the screws 30C and 30D pass through the corresponding two of the four mounting holes 22 of the deck 16 and the truck 12B, and are received by the threaded holes in the body 32B of the truck mounting assembly 18C.

In the embodiment of FIG. 2C, the truck mounting assembly 18D of FIG. 1 also includes two flat head machine screws and a body having a pair of threaded holes for receiving the screws. The threaded holes in the body correspond to the other two of the four mounting holes 22 in the deck 16 and in the truck 12B. The threaded shafts of the screws pass through the corresponding two of the four mounting holes 22 of the deck 16 and the truck 12B, and are received by the threaded holes in the body.

The threaded shafts of the screws 30A–30D may or may not be tapered. As noted above, fasteners with heads and threaded, non-tapered shafts are often called bolts. Thus in general the removable fasteners of the truck mounting assemblies 18A–18D of FIG. 1 may be screws or bolts. It is noted that other types of removable fasteners may also be used.

Figure 3:
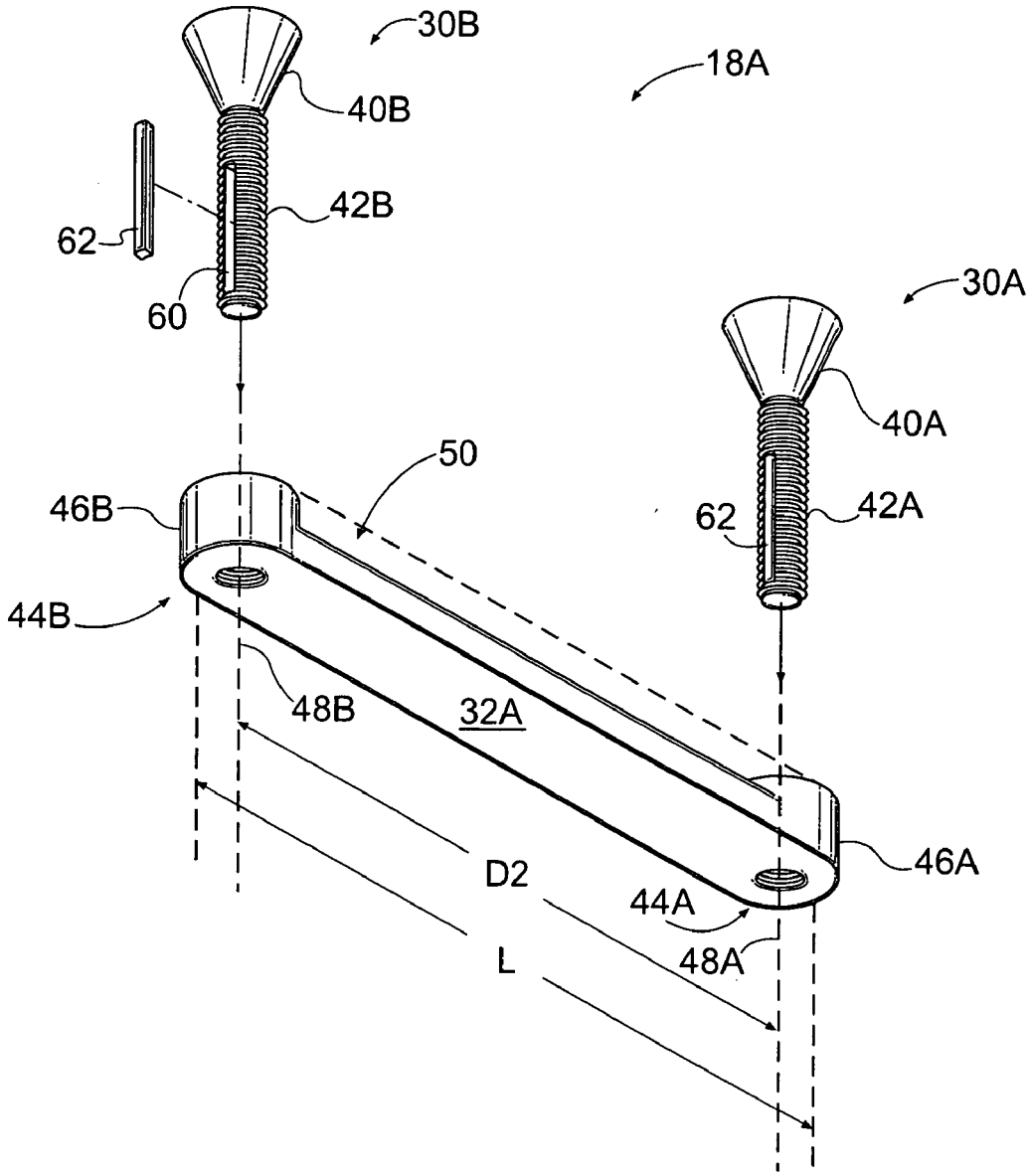
FIG. 3 is a perspective view of the truck mounting assembly of FIG. 2B.
Figure 4:
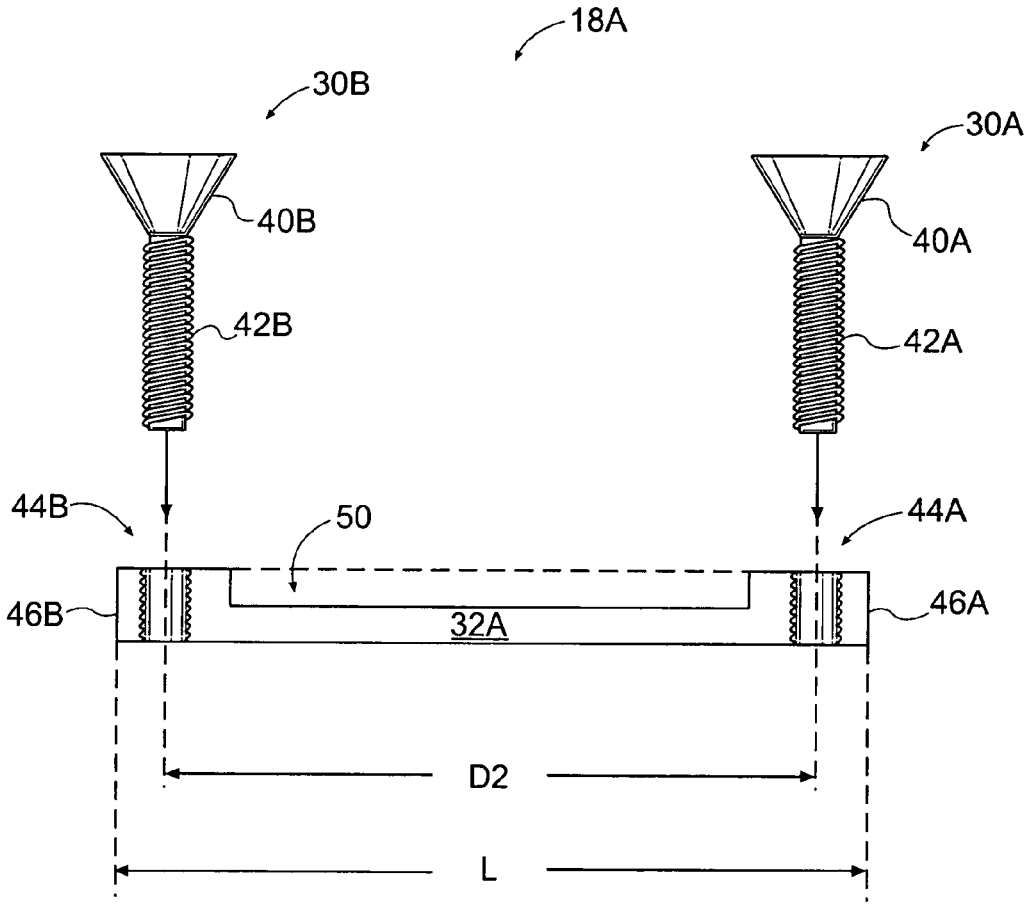
FIG. 4 is a side elevation view of the truck mounting assembly of FIG. 2B.

FIG. 3 is a perspective view of the truck mounting assembly 18A of FIG. 2B, and FIG. 4 is a side elevational view thereof. In the embodiment of FIGS. 3–4, the truck mounting assembly 18A includes the two flat head machine screws 30A and 30B and the body 32A. The heads of the screws 30A and 30B are labeled 40A and 40B, respectively, the threaded shafts of the screws 30A and 30B are labeled 42A and 42B, respectively, and the threaded holes of the body 32A are labeled 44A and 44B, respectively. Each of the threaded holes 44A and 44B passes through the body 32A. The threaded holes 44A and 44B are provided for receiving the threaded shafts 42A and 42B of the screws 30A and 30B, respectively. The threaded holes 44A and 44B are spaced about by the distance D2 of FIG. 1, and thus correspond to two of the four mounting holes 20 in the deck 16 and in the truck 12A. (See FIGS. 1 and 2B.)

In one embodiment, the screws 30A and 30B include a locking material 62 that functions to lock the screws 30A and 30B in the threaded holes 44A and 44B of the body 32A, to prevent them from inadvertently coming loose. In the present embodiment, the locking material 62 is a strip that is positioned in a slot 60 in the threaded shafts 42A and 42B of the screws 30A and 30B. The strip of locking material 62 may be Nylon® or similar material. The locking material 62 can be frictionally engaged in the slot 60, or the screws 30A and 30B can be preheated so that the locking material 62 is heat bonded within the slot 60.

While the present embodiment illustrates the locking material 62 being attached to the slot 60 in the screws 30A and 30B, these terms are expressly defined to include the inverse embodiment, wherein the slot 60 is in the threaded holes 44A and 44B of the body 32A. Such an alternative is expressly considered within the scope of the invention, as claimed. Furthermore, other alternative embodiments could also be used. The locking material 62 could be made of another suitable material, an in another shape or embodiment. For example, the locking material 62 could also be provided by the material sold by Henkel Loctite Corporation under the trademark LOCTITE®. In this alternative embodiment, the slot 60 is not required.

In the embodiment of FIG. 3, the body 32A has two opposed ends 46A and 46B and a major length dimension "L" extending between the ends 46A and 46B. The threaded hole 44A passes through the end 46A, and the threaded hole 44B passes through the end 46B. The threaded hole 44A has an axis 48A, and the threaded hole 44B has an axis 48B. The axes 48A and 48B are substantially parallel to one another and substantially perpendicular to the length dimension L of the body 32A. The ends 46A and 46B of the body 32A are preferably rounded as shown in FIG. 3 to prevent the body 32A from catching on external objects (e.g., curbs, handrails, ramps, etc.) during use of the skateboard 10 of FIG. 1.

In general, the body 32A may be formed from, or cast into, a solid block of a hard substance. The hard substance could be a metal such as aluminum, or metal alloy such as steel. The body 32A may also be formed from a hard plastic material or a synthetic resin such as nylon, or any other material having qualities suitable for these purposes.

In the embodiment of FIGS. 3 and 4, a portion 50 of the body 32A between the two ends 46A and 46B has been removed to allow for an uneven adjacent and corresponding surface of the truck 12A. For example, the adjacent and corresponding surface of the truck 12A may have structures protruding therefrom, and the removed portion 50 provides clearance between the body 32A and the structures. It is noted that in a preferred embodiment the truck mounting assemblies 18B–18D of FIG. 1 are similar to the truck mounting assembly 18A of FIG. 3.

The truck mounting assembly 18A of FIG. 3 may be formed by starting with a solid block of a suitable hard substance as described above. The portion 50 of the block between the two ends 46A and 46B may have already been removed. The pair of spaced apart holes 44A and 44B may be formed in the block (e.g., by drilling), wherein each of the holes passes through the block and corresponds to a different one of the mounting holes in the truck 12A. The holes 44A and 44B may then be adapted to receive the screws 30A and 30B, respectively. For example, the holes 44A and 44B may be tapped to receive the screws 30A and 30B, respectively. FIG. 4 is a side elevation view of the truck mounting assembly 18A of FIG. 2B.

One method of attaching the truck 12A of FIG. 1 to the underside surface 14 of the deck 16 of FIG. 1 via the truck mounting assembly 18A of FIGS. 3 and 4 includes positioning the truck 12A against the underside surface 14 such that the corresponding mounting holes of the deck 16 and the truck 12A are aligned. The body 32A of the truck mounting assembly 18A is positioned against the truck 12A such that the pair of threaded holes 44A and 44B of the body 32A are aligned with the corresponding mounting holes of the truck 12A. A thread lock material is preferably applied to the threaded shafts 42A and 42B of the respective screws 30A and 30B. The threaded shafts 42A and 42B of the respective screws 30A and 30B are passed through the corresponding mounting holes of the deck 16 and the truck 12A, and are threaded into the corresponding threaded holes 44A and 44B of the body 32A. The screws 30A and 30B are tightened by turning the respective heads 40A and 40B, thereby attaching the truck 12A to the underside surface 14 of the deck 16.

The truck mounting assemblies 18A–18D of FIG. 1 advantageously eliminate the need for a tool such as a wrench or socket to hold nuts in place while corresponding screws are tightened. For example, the threaded shafts of the two screws of one of the truck mounting assemblies 18 are preferably passed through corresponding mounting holes of a deck and a truck and threaded into the corresponding threaded holes of the body before being tightened. A first of the two screws is tightened while the other screw advantageously maintains alignment between the corresponding mounting holes of the deck and the truck and the corresponding threaded hole of the body. The other screw prevents the body from moving (i.e., spinning) while the first screw is being tightened. After the first screw is tightened, the other screw is tightened. It is also noted that the bodies of the truck mounting assemblies 18A–18D may be manufactured to be advantageously lighter than the traditional steel nuts currently used to secure skateboard trucks to underside surfaces of decks.

While the invention has been described with reference to at least one preferred embodiment, it is to be clearly understood by those skilled in the art that the invention is not limited thereto. Rather, the scope of the invention is to be interpreted only in conjunction with the appended claims.

All patents, patent applications, and other documents and printed matter cited or referred to in this application is hereby incorporated by reference in full.

What is claimed is:

1. A method for attaching a truck to a mating surface, wherein the truck and the mating surface have a plurality of corresponding mounting holes passing therethrough, the method comprising:

providing a truck mounting assembly, comprising:

a pair of removable fasteners each having a head and a threaded shaft; and a body having two opposed ends, each of the ends being rounded, the body also having a pair of spaced apart holes each passing through one of the two opposed ends, wherein each of the holes corresponds to a different one of the mounting holes of the truck and is adapted to threadedly engage one of the removable fasteners;

removing a portion from the body between the two opposed ends to provide clearance between the body and the truck;

positioning the truck against the mating surface such that the corresponding mounting holes of the mating surface and the truck are aligned;

positioning the body of the truck mounting assembly against the truck, opposite the mating surface, such that the pair of holes of the body are aligned with the corresponding mounting holes of the truck, and such that the portion between the two opposed ends of the body does not contact the truck;

passing the threaded shaft of each of the removable fasteners through the corresponding mounting holes of the mating surface and the truck such that the head abuts the mating surface; and threadedly engaging the threaded shaft of each of the removable fasteners with one of the pair of spaced apart holes of the body, thereby attaching the truck to the mating surface.

* * * * *